US006035152A

United States Patent [19]

Craig et al.

[11] Patent Number: 6,035,152

[45] Date of Patent: Mar. 7, 2000

[54] METHOD FOR MEASUREMENT OF TONE REPRODUCTION CURVE

[75] Inventors: David C. Craig, Rochester; Lam F. Wong, Fairport; Justine M. Woods, Webster, all of N.Y.

[73] Assignee: Xerox Corporation, Stamford, Conn.

[21] Appl. No.: 09/057,927

[22] Filed: Apr. 9, 1998

Related U.S. Application Data

[60] Provisional application No. 60/043,497, Apr. 11, 1997.

[51] Int. Cl.[7] ..... G03G 15/00; G03G 15/08

[52] U.S. Cl. ..... 399/49; 399/53

[58] Field of Search ..... 347/158; 399/15, 399/46, 48, 49, 50, 51, 53, 55, 59, 72

[56] References Cited

U.S. PATENT DOCUMENTS

| | | | |
|---|---|---|---|
| 5,436,705 | 7/1995 | Raj | 399/49 |
| 5,588,098 | 12/1996 | Chen et al. | 395/137 |
| 5,749,021 | 5/1998 | Mestha et al. | 399/49 |

*Primary Examiner*—Matthew S. Smith
*Assistant Examiner*—Hoang Ngo
*Attorney, Agent, or Firm*—Lloyd Bean, II

[57] ABSTRACT

A printing machine having a moving imaging surface, a projecting system for modulating a beam and projecting an image onto the imaging surface, a developer for application of toner to the image projected onto the imaging surface for transfer of the image to a medium, a method of development control including the steps of; generating a setup calibration tone curve base on a preset representative halftone patches; marking a test pattern in the interdocument zone of the imaging surface, the test pattern comprising a plurality of halftone patches; sensing the test pattern and measuring a relative reflection of each of said plurality of halftone patches in the interdocument zone of the imaging surface; entering said measured values into a matrix and correlating said matrix to a plurality of print quality actuators; generating a representative tone reproduction curve base on the matrix results; producing a feedback signal by comparing the representative tone reproduction curve to said setup calibration tone curve; and adjusting independently each of said print quality actuators to adjust printing machine operation for print quality correction

7 Claims, 4 Drawing Sheets

METHOD FOR MEASUREMENT OF TONE REPRODUCTION CURVE

This application claims priority from Patent Application; entitled, "IMPROVED METHOD FOR MEASUREMENT OF TONE REPRODUCTION CURVE", filed Apr. 11, 1997, provisional patent application Ser. No. 60/043,497.

BACKGROUND OF THE INVENTION

The invention relates to xerographic process control, and more particularly, to the improvement for measurement of tone reproduction curves by using a patch in the interdocument zone on a photoreceptor.

In copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch.

In any printing system using test patches for monitoring print quality, a design problem inevitably arises of where to place these test patches, particularly on photoreceptor belts or drums. Xerographic test patches are traditionally printed in the interdocument zones on the photoreceptor. They are used to measure the deposition of toner on paper to measure and control the tone reproduction curve (TRC). Generally each patch is about an inch square that is printed as a uniform solid half tone or background area. This practice enables the sensor to read values on the tone reproduction curve for each test patch.

The process controls which are generally monitored include the developability. Developability is the rate at which development (toner mass/area) takes place. Developability is typically monitored (and thereby controlled) using densitometers (e.g., IRDs) and by measuring toner concentration (TC) in the developer housing. As described above, IRDs measure total developed mass (i.e., on the imaging member), which is a function of developability and electrostatics. Thus, the developability cannot be determined using IRDs alone because the electrostatics of the imaging member also affect the mass of toner deposited on the imaging member by a developer device. TC is measured by directly measuring the percentage of toner in the developer housing (which, as is well known, contains toner and carrier particles). However, the relationship between TC and developability is affected by other variables such as ambient temperature, humidity and the age of the toner. For example, a 3% TC results in different developabilities depending on the variables listed above. Thus, maintaining TC at a predetermined value does not ensure a desired developability.

It is an object of the present invention therefore to provide a new and improved technique for process control, in particular, for establishing a tone reproduction curve. Other advantages of the present invention will become apparent as the following description proceeds, and the features characterizing the invention will be pointed out with particularity in the claims annexed to and forming a part of this specification.

SUMMARY OF THE INVENTION

A printing machine having a moving imaging surface, a projecting system for modulating a beam and projecting an image onto the imaging surface, a developer for application of toner to the image projected onto the imaging surface for transfer of the image to a medium, a method of development control including the steps of; generating a setup calibration tone curve base on a preset representative halftone patches; marking a test pattern in the interdocument zone of the imaging surface, the test pattern comprising a plurality of halftone patches; sensing the test pattern and measuring a relative reflection of each of said plurality of halftone patches in the interdocument zone of the imaging surface; entering said measured values into a matrix and correlating said matrix to a plurality of print quality actuators; generating a representative tone reproduction curve base on the matrix results; producing a feedback signal by comparing the representative tone reproduction curve to said setup calibration tone curve; and adjusting independently each of said print quality actuators to adjust printing machine operation for print quality correction.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 7:
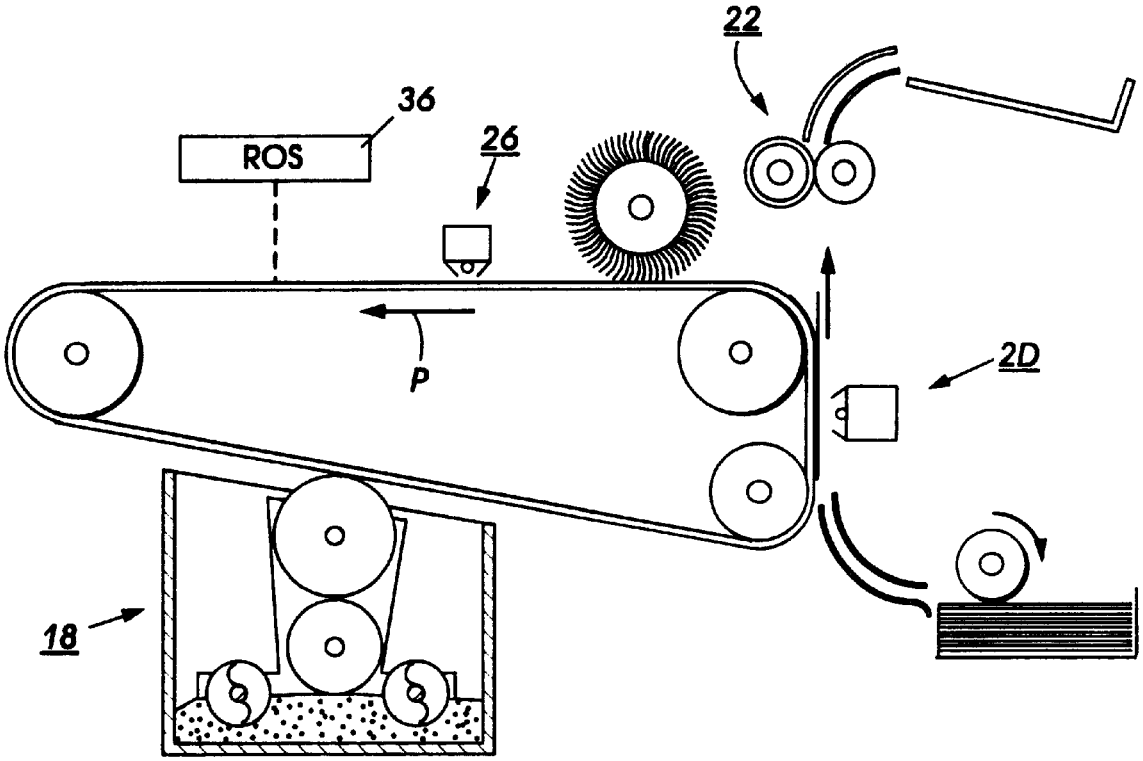
FIG. 7 is an elevational view illustrating a typical electronic imaging system incorporating tone reproduction curve control in accordance with the present invention.

FIG. 7 shows the basic elements of the well-known system by which an electrophotographic printer or laser printer uses digital image data to create a dry-toner image on plain paper. There is provided in the printer a photoreceptor 10, which may be in the form of a belt or drum, and which comprises a charge-retentive surface. The photoreceptor 10 is here entrained on a set of rollers and caused to move (by means such as a motor, not shown)through process direction P. Moving from left to right in FIG. 7, there is illustrated the basic series of steps by which an electrostatic latent image according to a desired image to be printed is created on the photoreceptor 10, subsequently developed with dry toner, and transferred to a sheet of plain paper.

The first step in the electrophotographic process is the general charging of the relevant photoreceptor surface. This initial charging is performed by a charge source known as a "scorotron", indicated as 26. The scorotron 26 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS 36, which generally comprises laser source (not shown) and a rotatable mirror (not shown) which act together, in a manner known in the art, to discharge certain areas of the charged photoreceptor 10. Although a laser source is shown to selectively discharge the charge-retentive surface, other apparatus that can be used for this purpose include an LED bar, or, conceivably, a light-lens system. The laser source is modulated (turned on and off) in accordance with digital image data fed into it, and the rotating mirror causes the modulated beam from laser source to move in a fast-scan direction perpendicular to the process direction P of the photoreceptor 10. The laser source outputs a laser beam of laser power which charges or discharges the exposed surface on photoreceptor 10, in accordance with the specific machine design.

After certain areas of the photoreceptor 10 are (in this specific instance) discharged by the laser source, remaining charged areas are developed by a developer unit such as 18 causing a supply of dry toner to contact the surface of photoreceptor 10. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon is then passed through a fuser 22, which causes the toner to melt, or fuse, into the sheet of paper to create the permanent image.

The idea of "print quality" can be quantified in a number of ways, but two key measurements of print quality are (1) the solid area density, which is the darkness of a representative developed area intended to be completely covered by toner and (2) a halftone area density, which is the copy quality of a representative area which is intended to be, for example, 50% covered with toner. The halftone is typically created by virtue of a dot-screen of a particular resolution, and although the nature of such a screen will have a great effect on the absolute appearance of the halftone, as long as the same type of halftone screen is used for each test, any common halftone screen may be used. Both the solid area and halftone density may be readily measured by optical sensing systems which are familiar in the art. As shown, a densitometer generally indicated as 24 is here used after the developing step to measure the optical density of a solid density test patch (marked SD) or a halftone density test patch (HD) created on the photoreceptor 10 in a manner known in the art. Systems for measuring the true optical density of a test patch are shown in, for example, U.S. Pat. No. 4,989,985 or U.S. Pat. No. 5,204,538, both assigned to the assignee hereof and incorporated by reference herein. However, the word "densitometer" is intended to apply to any device for determining the density of print material on a surface, such as a visible-light densitometer, an infrared densitometer, an electrostatic voltmeter, or any other such device which makes a physical measurement from which the density of print material may be determined.

In accordance with the present invention, there is a process setup method that uses preferably a BTAC sensor to monitor the relative reflectance's (RR) of 12.5, 50 and 87.5% area coverage halftone patches placed in the photoreceptor ID zone. Five control actuators are used to control the RR of these patches: charge, exposure, donor roll bias, jumping AC voltage, and TC (tribo) without a TC sensor. But these actuators effect all three patch RR's. Another way to see the problem, however, is to control the translation, inflection and rotation of the RR curve. If we adopt these transformations then it becomes clear that Jumping AC should be moved when there is RR translation and charge, exposure or donor bias should be moved when there is RR inflection, and finally, TC (tribo) should be moved when there is RR rotation. The explicit coupling nature of translation to jumping AC, inflection to electrostatics, and rotation to TC (tribo) can be used to center jumping AC (field), electrostatics and TC (tribo) during the setup process.

Figure 1:
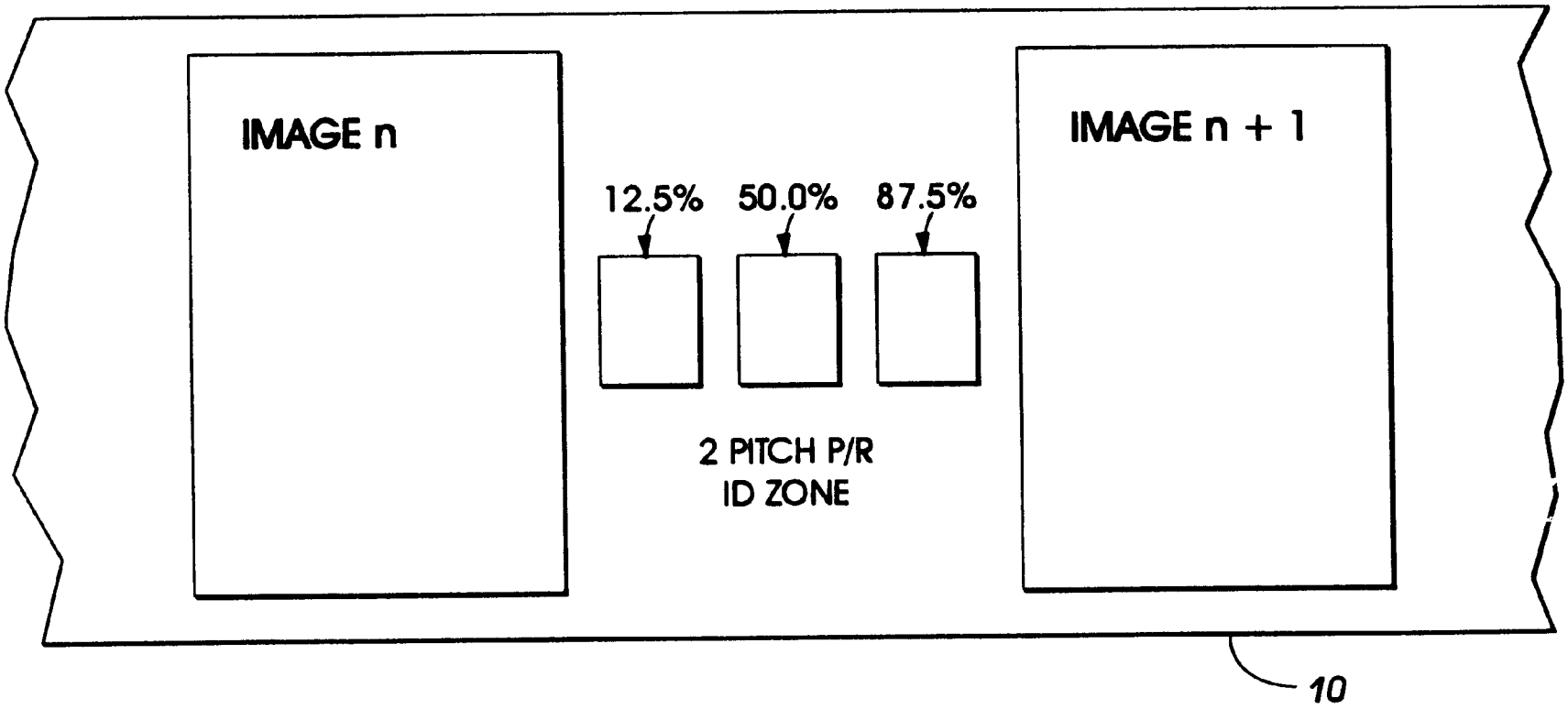
FIG. 1 illustrates a top view of the photoreceptor of FIG. 7 incorporating the present invention.
Figure 2:
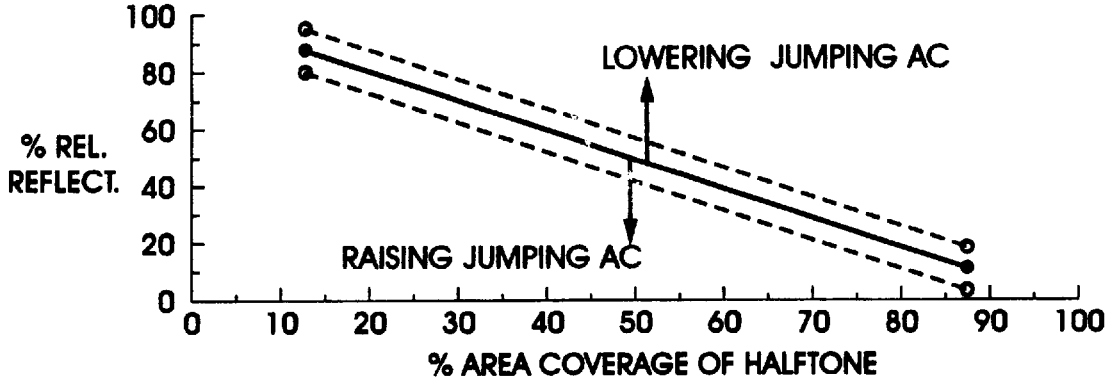
FIG. 2 illustrates the effects of Vjump of the RR curve.

FIG. 1 illustrates the basic process control/setup method. A BTAC sensor is used to monitor the relative reflectance (RR) of a 12.5, 50.0, and 87.5% area coverage patch placed in the interdocument zone. In the present invention, we now introduce the following transformations before deciding which actuator to move in response to a difference between the patch RR's and their targets (see FIG. 2 for illustration):

(1) $\text{Translation}=(RR12.5_{target}-RR12.5_{actual})+(RR87.5_{target}-RR87.5_{actual})$ (2) $\text{Rotation}=(RR12.5_{target}-RR12.5_{actual})-(RR87.5_{target}-RR87.5_{actual})$ (3) $\text{Inflection}=((RR12.5_{target}-RR12.5_{actual})+(RR87.5_{target}-RR87.5_{actual}))/2-(RR50.0_{target}-RR50.0_{actual})$ The target value for translation, rotation and inflection is 0.0; hence, translation, rotation and inflection are a measure of error from target. The advantage of using these parameters, as opposed to simply controlling in terms of RR 12.5, RR50, and RR87.5, is that it then becomes very clear regarding which actuator should be changed when there is an error between actual and target, in other words, minimizing the coupling:

(1) If translation, change Jumping AC—(see FIG. 2 for illustration of effect on Vjump of RR curve).

Figure 3:
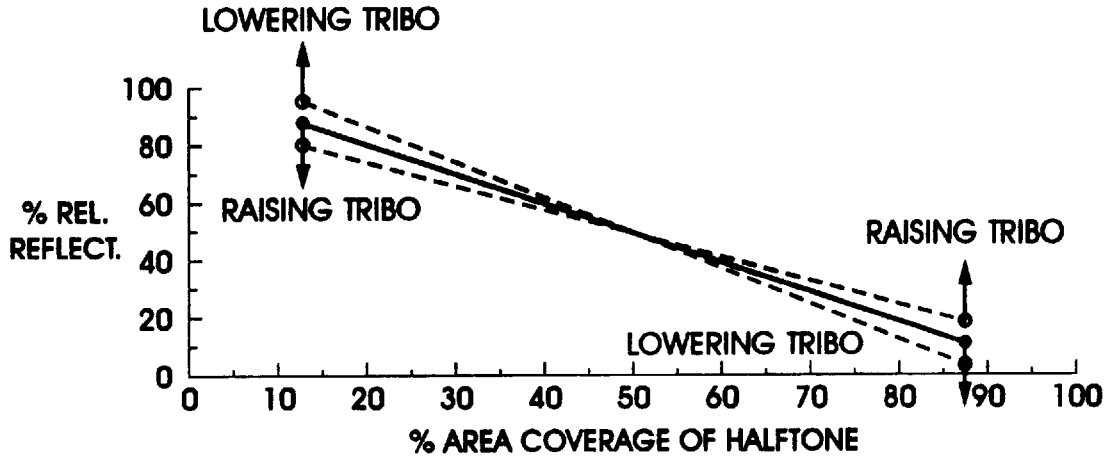
FIG. 3 illustrates the effect of TC (tribo) on the RR curve.

(2) If rotation, change toner concentration (TC)—(see FIG. 3 for illustration of effect of TC (tribo) on RR curve).

Figure 4:
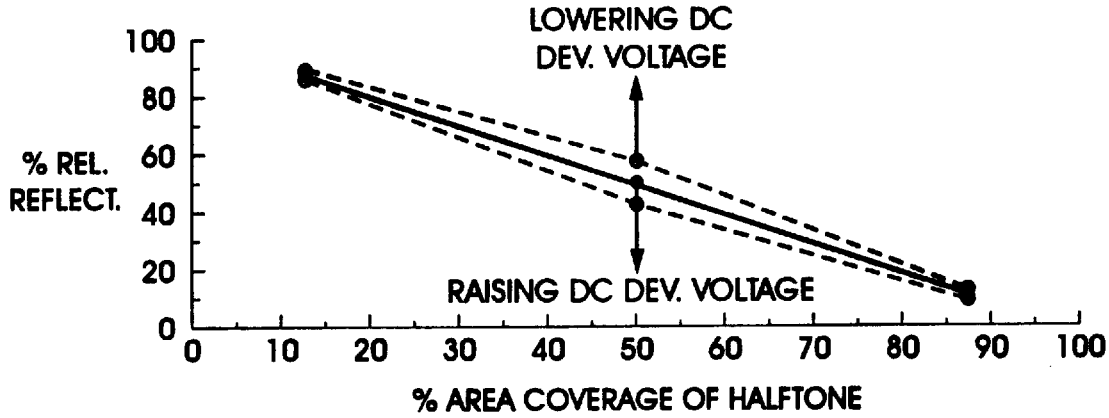
FIG. 4 illustrates the effect of charge exposure or donor bias on the RR curve.

(3) If inflection, change dc development voltage (charge, exposure or donor/mag bias)—(see FIG. 4 for illustration of effect on RR curve).

Figure 5:
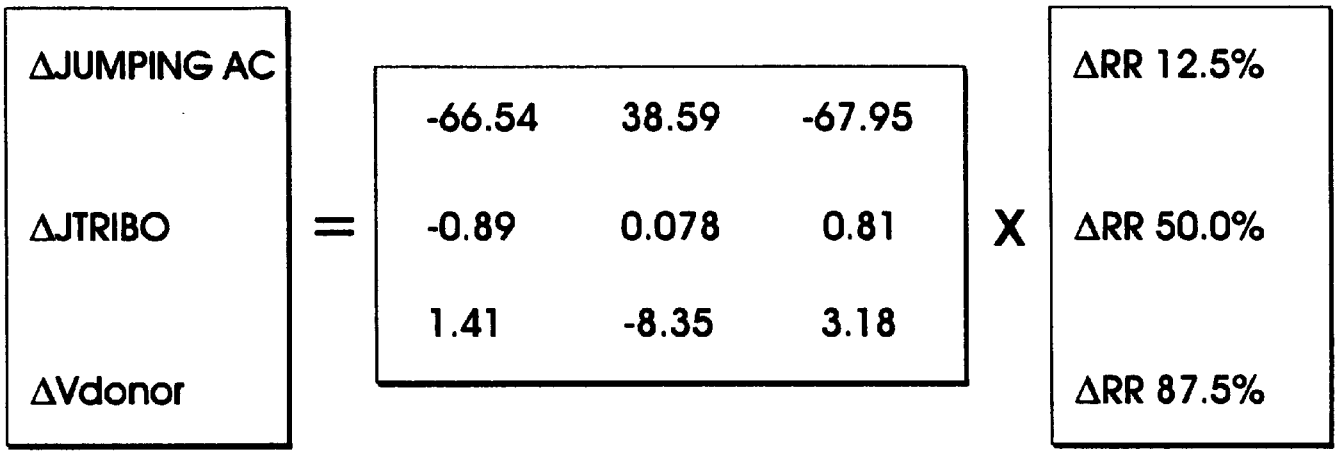
FIGS. 5 and 6 show the matrix coefficients used in the present invention.

In terms of their matrix formulation FIG. 5 shows the matrix coefficients when changes in the actuators (jumping AC, tribo and donor bias) are simply related to changes in the individual relative reflectance's of the control patches.

Figure 6:
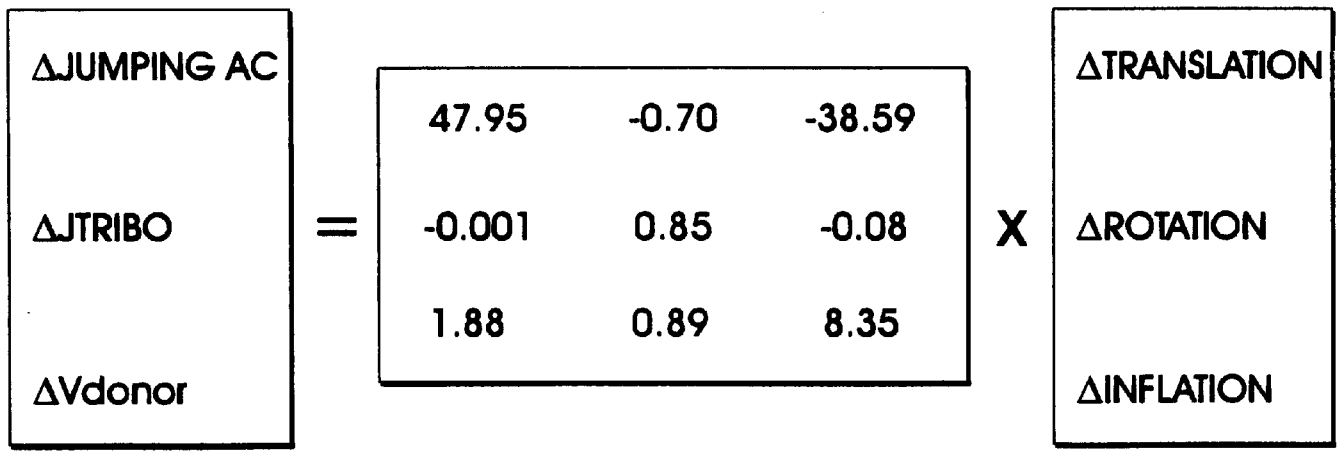

The matrix is not even close to diagonal as many of the off-diagonal terms are greater than the diagonal terms. If, however, we apply the proposed transformations (shown in FIG. 6) and think in terms of translation, rotation and inflection then the matrix becomes more diagonal and it becomes more clear which actuator should be changed when there is either translation, rotation or inflection. The numerical values in the 2 matrices are the result of regressing over 225 data points. Clearly, we should change jumping AC when there is translation, tribo when there is rotation and donor bias when there is inflection (exposure and charging can also be used to correct for inflection).

Having in mind the concept and principles of the present invention, it is believed that complete understanding of the invention may be had from description of the following computer code.

```
/*
* BUILDer project: Irbsetup
*
* user_main module: Irbsetup.c (control prototype using translation, rotation, inflection strategy)
*
*/
#include "bId_Irbsetup.h"
#include "Irbsetup.h"
#include <math.h>
#include <time.h>
#include <string.h>
double      deltatc;
char        filename[200], filename2[200], filename3[200];
/* user initialization code */
int
user_init2(int argc, char **argv, char **envp)
{
    int         user_init_status = 0;
    bId_set(iteration_KEY,,BLD_VALUE, "1");
    bId_set(vgridcontrol_KEY, BLD_VALUE, "110");
    bId_set(exposurecontrol_KEY, BLD_VALUE, "75");
    bId_set(vdonorcontrol_KEY, BLD_VALUE, "148");
    bId_set(vjump_KEY, BLD_VALUE, "157");
    bId_set(stepsize_KEY, BLD_VALUE, "0.75");
    bId_set(exposecal_KEY, BLD_VALUE, "0.11");
    bId_set(changetc_KEY, BLD_VALUE, "0.0");
    bId_set(speed_KEY, BLD_VALUE, 1);
    bId_set(machine_KEY, BLD_VALUE, "0");
/**************************************************/
/**************************************************/
/**                                              **/
/**    program specific initialization code 2    **/
/**                                              **
/**************************************************/
/**************************************************/
return (user_init_status);
}
void
do_compute(int key, CALLBACK_DATA * callback, CLIENT_DATA * client)
    FILE        *fpout1, *fpout2, *fpout3;
    char        *buffer, *machine cru_buffer[20], ros_buffer[20], housing_buffer[20],
                labelfolder[150], date[150], thetime[150];
    char        *buffer0, *buffer1, *buffer2, *buffer3, *buffer4, *buffer5, *buffer6;
    char        brr125[25], brr50[25], brr875[25], bvgrid[25],
                bvdonor[25], bvjump[25], btc[25], bvjumpnom[25], bvjumpmin[25],
bvjumpmax[25];
    char        bexpose[25], bdeltatc[25], btranslation[25], brotation[25],
                binflection[25], dispenserate[50], printtype[50];
    char        *null = " ";
    char        tc_buffer[20]at_buffer[20], gap_buffer[20], tribo_buffer[20];
    int         vgridcontrol, exposurecontrol, vdonorcontrol, vjumpcontrol;
    int         vjumpmin, vjumpmax, vjumpnom;
    int         badrr0, badrr1, badrr2, badrr3, badexposecal;
    int         iteration, convergence, numberprints, speed, SPEED,
                update;
    double      rrf0, rrf1, rrf2, rrf3, rr125, rr50, rr875;
    double      rrf0_old, rrf1_old, rrf2_old, rrf3_old;
    double      inflection, rotation, translation;
    double      rr125target, rr50target, rr875target;
    double      bkgd, reload, gap, at, tribo, tc, tc_old, at_old
    double      error125, error50, error875;
    double      spec125, spec50, spec875;
    double      vjumpvolts, vdonorvolts, vgridvolts, exposurecal, ergs,
                stepsize;
    double      electrostatic_partition, deltavgrid, deltavdonor, deltaergs,
                deltavjump, vcleanvolts;
    char        year[10], mon[10], day[10], hour[10], min[10];
    time_t      now;
```

-continued

```
    struct tm     *tmstruct;
    buffer = (char *) bId_get(iteration_KEY, BLD_VALUE);
    sscanf(buffer, "%d", &iteration);
    convergence = 0;
    if (iteration == 1) {
        time(&now);
        tmstruct = localtime(&now);
        tmstruct—>tm_mon = tmstruct—>tm_mon + 1;
        machine = (char *) bId_get(machine_KEY, BLD_VALUE);
        if (tmstruct—>tm year < 10)
            sprintf(year, "0%d", tmstruct—>tm_year);
        else
            sprintf(year, "%d", tmstruct—>tm_year);
        if (tmstruct—>tm_mon < 10)
            sprintf(mon, "0%d", tmstruct—>tm_mon);
        else
            sprintf(mon, "%d" tmstruct—>tm_mon);
        if (tmstruct—>tm_mday < 10)
            sprintf(day, "0%d", tmstruct—>tm_mday);
        else
            sprintf(day, "%d", tmstruct—>tm_mday);
        if (tmstruct—>tm_hour < 10)
            sprintf(hour, "0%d", tmstruct—>tm_hour);
        else
            sprintf(hour, "%d", tmstruct—>tm_hour);
        if (tmstruct—>tm_min < 10)
            sprintf(min, "0%d", tmstruct—>tm_min);
        else
            sprintf(min, "%d", tmstruct—>tm_min);
        sprintf(filename, "/home/guest/Irbsetup/MC%s.%s.%s.%s.%s.%s", machine,
year, mon, day, hour, min);
        sprintf(filename2, "/home/guest/Irbsetup/MC%s.%s.%s.%s.%s.%s.graph1",
machine, year, mon, day, hour, min);
        sprintf(filename3, "/home/guest/Irbsetup/MC%s.%s.%s.%s.%s.%s.graph2"
machine, year, mon, day, hour, min);
        sprintf(labelfolder, "MC%s.%s.%s.%s.%s.%s", machine, year, mon, day, hour,
min);
        bId_set(labelfolder_KEY, BLD_VALUE, labelfolder);
        sprintf(date, "%s/%s/%s", year, mon, day);
        sprintf(thetime, "%s:%s", hour, min);
    }
speed = bId_get(speed_KEY, BLD_VALUE);
        if (speed == 0) {
            rr125target = 87.0;
            rr50target = 46.5;
            rr875target = 10.0;
            SPEED = 40;
        }
        if(speed == 1){
            rr125target = 87.0;
            rr50target = 46.5;
            rr875target = 11.0;
            SPEED = 65;
        }
        spec125 = 2;
        spec50 = 2;
        spec875 = 1;
    buffer4 = (char *) bId_get(stepsize_KEY, BLD_VALUE);
    sscanf(buffer4, "%lf", &stepsize);
    buffer0 = (char *) bId_get(rrf0_KEY, BLD_VALUE);
    sscanf(buffer0, "%lf", &rrf0);
    buffer1 = (char *) bId_get(rrf1_KEY, BLD_VALUE);
    sscanf(buffer1, "%lf", &rrf1);
    buffer2 = (char *) bId_get(rrf2_KEY, BLD_VALUE);
    sscanf(buffer2, "%lf", &rrf2);
    buffer3 = (char *) bId_get(rrf3_KEY, BLD_VALUE);
    sscanf(buffer3, "%lf", &rrf3);
    update = 1;
    if (iteration != 1)
        if (rrf0 == rrf0_old && rrf1 == rrf1_old && rrf2 == rrf2_old && rrf3 == rrf3_old &&
convergence == 0)
            update = 0;
    rrf0_old = rrf0;
    rrf1_old = rrf1;
    rrf2_old = rrf2;
    rrf3_old = rrf3;
    badrr0 = 0;
    badrr1 = 0;
    badrr2 = 0;
```

-continued

```
    badrr3 = 0;
    badexposecal = 0;
    buffer6 = (char *) bId_get(exposecal_KEY, BLD_VALUE);
    sscanf(buffer6, "%lf", &exposurecal);
    if (exposurecal >0.2 || exposurecal < 0.06) {
        bId_set(checkexposecal_KEY, BLD_VALUE, 1);
        badexposecal = 1;
    } else
        bId_set(checkexposecal_KEY, BLD_VALUE, 0);
    if (rrf0 >200 || rrf0 < 90) {
        bId_set(checkrr0_KEY, BLD_VALUE, 1);
        badrr0 = 1;
    } else
        bId_set(checkrr0_KEY, BLD_VALUE, 0);
    if (rrf1 > 175 || rrf1 < 90) {
        bId_set(checkrr1_KEY, BLD_VALUE, 1);
        badrr1 = 1;
    } else
        bId_set(checkrr1_KEY, BLD_VALUE, 0);
    if (rrf2 > 140 || rrf2 < 30) {
        bId_set(checkrr2_KEY, BLD_VALUE, 1);
        badrr2 = 1;
    } else
        bId_set(checkrr2_KEY, BLD_VALUE, 0);
    if(rrf3 > 140 || rrf3 < 5) {
        bId_set(checkrr3_KEY, BLD_VALUE, 1);
        badrr3 = 1;
    } else
        bId_set(checkrr3_KEY, BLD_VALUE, 0);
    if (badrr0 == 0 && badrr1 == 0 && badrr2 == 0 && badrr3 == 0 && badexposecal == 0
&& update == 1) {
        fpout1 = fopen(filename, "a");
        buffer = (char *) bId_get(vgridcontrol_KEY, BLD_VALUE);
        sscanf(buffer, "%d", &vgridcontrol);
        buffer = (char *) bId_get(exposurecontrol_KEY, BLD_VALUE);
        sscanf(buffer, "%d", &exposurecontrol);
        buffer = (char *) bId_get(vdonorcontrol_KEY, BLD_VALUE);
        sscanf(buffer, "%d", &vdonorcontrol);
        buffer = (char *) bId_get(vjump_KEY, BLD_VALUE);
        sscanf(buffer, "%d", &vjumpcontrol);
        rr125 = (rrf1 / rrf0) * 100;
        rr50 = (rrf2 / rrf0) * 100;
        rr875 = (rrf3 / rrf0) * 25;
        sprintf(brr125, "%.2lf", rr125);
        bId_set(rr125_KEY, BLD_VALUE, brr125);
        sprintf(brr50, "%.2lf", rr50);
        bId_set(rr50_KEY, BLD_VALUE, brr50);
        sprintf(brr875, "%.2lf", rr875);
        bId_set(rr875_KEY, BLD_VALUE, brr875);
        error125 = rr125target - rr125;
        error50 = rr50target - rr50;
        error875 = rr875target - rr875;
        convergence = 0;
        if (fabs(error125) < spec125 && fabs(error50) < spec50 && fabs(error875) <
spec875) {
            bId_set(converge_KEY, BLD_VALUE, 1);
            convergence = 1;
                }
        if (fabs(error125) < 1 && fabs(error50) < 1 && fabs(error875) < 0.5) {
            bId_set(superconverge_KEY, BLD_VALUE, 1);
            convergence = 2;
        }
        if(convergence == 0)
        {
            bId_set(converge_KEY, BLD_VALUE, 0);
            bId_set(superconverge_KEY, BLD_VALUE, 0);
        }
/****** DEFINITION OF ROTATION, TRANSLATION AND INFLECTION *****/
        rotation = (rr125target - rr125) - (rr875target - rr875);
        translation = (rr125target - rr125) + (rr875target - rr875);
        inflection = (rr875 + rr125) / 2 - rr50 - 2.50;
        sprintf(brotation, "0/0.2lf", rotation);
        bId_set(rotation_KEY, BLD_VALUE, brotation);
        sprintf(binflection, "%.2lf", inflection);
        bId_set(inflection_KEY, BLD_VALUE, binflection);
        sprintf(btranslation, "%.2lf", translation);
        bId_set(translation_KEY, BLD_VALUE, btranslation);
        buffer = (char *) bId_get(cru_KEY, BLD_VALUE);
        if (strcmp(buffer, null) == 0)
```

-continued

```
            sprintf(cru_buffer, "%s", "NA");
        else
            sprintf(cru_buffer, "%s", buffer);
        buffer = (char *) bId_get(tc_KEY, BLD_VALUE);
        if (strcmp(buffer, null) == 0)
            sprintf(tc_buffer, "%s", "NA");
        else
            sprintf(tc_buffer, "%s", buffer);
        buffer = (char *) bId_get(ros_KEY, BLD_VALUE);
        if (strcmp(buffer, null) == 0)
            sprintf(ros_buffer, "%s", "NA");
        else
            sprintf(ros_buffer, "%s", buffer);
        buffer (char *) bId_get(at_KEY, BLD_VALUE);
        if (strcmp(buffer, null) == 0)
            sprintf(at_buffer, "%s", "NA");
        else
            sprintf(at_buffer, "%s", buffer);
        buffer = (char *) bId_get(tribo_KEY, BLD_VALUE);
        if (strcmp(buffer, null) == 0)
            sprintf(tribo_buffer "%s", "NA");
        else
            sprintf(tribo_buffer "%s", buffer);
        buffer = (char *) bId_get(housing_KEY, BLD_VALUE);
        if (strcmp(buffer, null) == 0)
            sprintf(housing_buffer, "%s", "NA");
        else
            sprintf(housing_buffer, "%s", buffer);
        buffer = (char *) bId_get(gap_KEY, BLD_VALUE):
        if (strcmp(buffer, null) == 0)
            sprintf(gap_buffer, "%s", "NA");
        else
            sprintf(gap_buffer, "%s", buffer);
        if (iteration == 1) {
            fprintf(fpout1, "\n\nMC: %s Date: %s Time: %s\n\n", machine, date,
thetime);
            fprintf(fpout1, "\n\nStatic Parameters:\n\nSpeed: %d Gap: %s
CRU_ID: %s ROS_ID: %s DevHousingID: %s ExpCal: %.3If\n", SPEED, gap_buffer,
cru_buffer, ros_buffer, housing_buffer, exposurecal);
            fprintf(fpout1, "\n\n\n\n\nDynamic
Parameters:\n\n#\tVddp\tExp\tDonor\tJump\tVclean\tchTC\tTC\tAt\tTribo\nRR12.5\tRR50\tRR87.
5\tTrans\tRota\tInflec\tConv?\n\n");
        }
        vdonorvolts = vdonorcontrol * 1.95;
        vgridvolts = 300 + (vgridcontrol − 25) * 2.6;
        ergs = exposurecontrol * exposurecal;
        vjumpvolts = (vlumpcontrol − 30) * 5.2 + 1600
        vcleanvolts = vgridvolts − (vdonorvolts + 75);
        fprintf(fpout1,
"%d\t%.0If\t%.1If/\t%.0If\t%.0If\5%.0IF\t%.2If\t%s\t%s\t%s\n%.1If\t%.1If\t%.1If\t%.1If\t%.1If\t%.1If\t
%d\n\n", iteration, vgridvolts, ergs, vdonorvolts, vjumpvolts, vcleanvolts, deltatc, tc_buffer,
at_buffer, tribo_buffer, rr125, rr50, rr875, translation, rotation, inflection, convergence);
            iteration++;
            sprintf(buffer, "%d", iteration);
            bId_set(iteration_KEY, BLD_VALUE, buffer);
/***** ROTATION, TRANSLATION and INFLECTION AIGORITHM ****** /
        deltavjump = −(57.93 * translation − 7.1018798 * rotation − 47.22866054 *
inflection) * stepsize;
        deltatc = −(−0.003 * translation − 0.308 * rotation + 0.0395 * inflection) * stepsize;
        etectrostatic_partition = 0.33333;
        deltavdonor = −(1.6 * translation + 3.29 * rotation + 8.28 * inflection) * stepsize;
electrostatic_partition;
        deltavgrid = −1.33 * deltavdonor;
        deltaergs = 0.042 * deltavdonor;
        vdonorvolts = vdonorvolts + deltavdonor;
        ergs = ergs + deltaergs;
        vgridvolts = vgridvolts + deltavgrid;
        vjumpvolts = vjumpvolts + deltavjump;
        if (vjumpvolts < 1700)
            vjumpvolts = 1700;
        if (vjumpvolts > 2800)
            vjumpvolts = 2800;
        if (vgridvolts > 700)
            vgridvolts = 700;
        if (vgridvolts < 400)
            vgridvolts = 400;
        if (ergs > 12)
            ergs = 12;
        if (ergs < 6.5)
```

-continued

```
        ergs = 6.5;
    vcleanvolts = vgridvolts − (vdonorvolts + 75);
    if (vcleanvolts < 25) {
        vdonorvolts = vgridvolts − 25 − 75;
        vcleanvolts = 25;
    }
    if (vcleanvolts >275) {
        vdonorvolts = vgridvolts − 275 − 75;
        vcleanvolts = 275;
    }
    vdonorcontrol (int) (vdonorvolts / 1.95);
    vgridcontrol = (int) ((vgridvolts − 300) / 2.6 + 25);
    vjumpcontrol = (int) ((vjumpvolts − 1600) / 5.2 + 30);
    exposurecontrol = (int) (ergs / exposurecal);
    if(convergence == 1 || convergence == 2)
    {
        vjumpnom = vjumpcontrol;
        vjumpmin = vjumpnom − 50;
        if(vjumpmin < 0)
            vjumpmin = 0;
        vjumpmax = vjumpnom + 50;
        if(vjumpmax > 255)
            vjumpmax = 255;
        sprintf(bvjumpnom, "%d", vjumpnom);
        bId_set(vjumpnom_KEY, BLD_VALUE, bvjumpnom);
        sprintf(bvjumpmin, "%d", vjumpmin);
        bId_set(vjumpmin_KEY, BLD_VALUE, bvjumpmin);
        sprintf(bvjumpmax, "%d_, vjumpmax);
        bId_set(vjumpmax_KEY, BLD_VALUE, bvjumpmax);
    }
    else
    {
        bId_set(vjumpnom_KEY, BLD_VALUE, "NA");
        bId_set(vjumpmin_KEY, BLD_VALUE, "NA");
        bId_set(vjumpmax_KEY, BLD_VALUE, "NA"),
    }
    sprintf(bdeltatc, "%.2If", deltatc);
    bId_set(changetc_KEY, BLD_VALUE, bdeltatc);
    sprintf(bexpose, "%d", exposurecontrol);
    bId_set(exposurecontrol_KEY, BLD_VALUE, bexpose);
    sprintf(bvgrid, "%d", vgridcontrol);
    bId_set(vgridcontrol_KEY, BLD_VALUE, bvgrid);
    sprintf(bvdonor, "%d", vdonorcontrol);
    bId_set(vdonorcontrol_KEY, BLD_VALUE, bvdonor);
    sprintf(bvjump, "%d", vjumpcontrol);
    bId_set(vjump_KEY, BLD_VALUE, bvjump);
    if(deltatc > 0.0) {
        numberprints = (int) (deltatc / 0.1) * 8;
        sprintf(prinftype, "run %d ETP106_0" numberprints);
        bId_set(whichprints_KEY, BLD_VALUE, printtype);
        sprintf(dispenserate, "With dispense rate = 500,");
        bId_set(dispenserate_KEY, BLD_VALUE, dispenserate);
    }
    if (deltatc < 0.0) {
        numberprints = −(int) (deltatc / 0.1) * 4;
        sprintf(printtype, "run %d ETP106_50" numberprints);
        bId_set(whichprints_KEY, BLD_VALUE, printtype);
        sprintf(dispenserate, "With dispense rate = 10,");
        bId_set(dispenserate_KEY, BLD_VALUE, dispenserate);
    }
    fclose(fpout1);
}
```

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a printing machine having a moving imaging surface, a projecting system for modulating a beam and projecting an image onto the imaging surface, a developer for application of toner to the image projected onto the imaging surface for transfer of the image to a medium, a method of development control comprising the steps of:

generating a setup calibration tone curve base on a preset representative halftone patches;

marking a test pattern in an interdocument zone of the imaging surface, wherein the test pattern comprises a plurality of halftone patches;

sensing the test pattern and measuring a relative reflection of each of said plurality of halftone patches in the interdocument zone of the imaging surface;

entering said measured values into a matrix and correlating said matrix to a plurality of print quality actuators;

generating a representative tone reproduction curve base on the matrix results, said generating step includes calculating a plurality of transformations of said matrix;

producing a feedback signal by comparing the representative tone reproduction curve to said setup calibration tone curve; and adjusting independently each of said print quality actuators to adjust printing machine operation for print quality correction, said plurality of print quality actuators consisting of values for charge, exposure, donor roll bias, jumping AC voltage, and toner concentration.

2. The method of claim 1, wherein one of said plurality of transformation is a rotation transformation.

3. The method of claim 2, further comprising the steps of:

comparing said rotation transformation to a target value;

adjusting said toner concentration in response to said comparing step.

4. The method of claim 1, wherein one of said plurality of transformation is a translation transformation.

5. The method of claim 4, further comprising the steps of:

comparing said translation transformation to a target value;

adjusting said jumping AC in response to said comparing step.

6. The method of claim 1, wherein one of said plurality of transformation is s inflection transformation.

7. The method of claim 6, further comprising the steps of:

comparing said inflection transformation to a target value;

adjusting said charge, exposure and donor roll bias in response to said comparing step.

* * * * *